US005681041A

United States Patent [19]

Coon

[11] Patent Number: 5,681,041

[45] Date of Patent: Oct. 28, 1997

[54] THREE DIMENSIONAL PUZZLE

[76] Inventor: Raymond S. Coon, 109 Boley St., Oak Hill, W. Va. 25901

[21] Appl. No.: 721,016

[22] Filed: Sep. 26, 1996

Related U.S. Application Data

[60] Provisional application No. 60/004,629 Nov. 26, 1995.

[51] Int. Cl.[6] ..... A63F 9/12

[52] U.S. Cl. ..... 273/157 R; 273/160; 446/114; 446/377

[58] Field of Search ..... 273/153 R, 157 R, 273/160, 156; 446/113, 114, 115, 377

[56] References Cited

U.S. PATENT DOCUMENTS

| | | | |
|---|---|---|---|
| D. 257,369 | 10/1980 | Kodaka . | |
| D. 257,370 | 10/1980 | Kodaka . | |
| D. 257,371 | 10/1980 | Kodaka . | |
| D. 257,372 | 10/1980 | Kodaka . | |
| D. 257,373 | 10/1980 | Kodaka . | |
| D. 257,514 | 11/1980 | Kodaka . | |
| 1,211,590 | 1/1917 | Kennedy | 273/157 R |
| 1,706,388 | 3/1929 | Ashkenas | 446/114 |
| 1,910,089 | 2/1933 | Chomik | 446/114 |
| 2,585,419 | 2/1952 | Zarlengo | 273/157 R |
| 3,407,530 | 10/1968 | Grant et al. | 273/157 R |
| 3,468,056 | 9/1969 | Gardel et al. | 446/377 |
| 3,570,169 | 3/1971 | Jacob | 446/114 |
| 4,118,887 | 10/1978 | Appleman . | |
| 4,192,509 | 3/1980 | Singh | 273/157 R |
| 4,570,936 | 2/1986 | Meiser et al. | 273/157 R |

*Primary Examiner*—Steven B. Wong
*Attorney, Agent, or Firm*—Richard C. Litman

[57] ABSTRACT

A three-dimensional, representational puzzle having frictionally mating pieces with selected pivoting pieces which allow motion of the puzzle when assembled. The exemplary puzzle is representative of a dinosaur, wherein a V-shaped cut-out is provided in a pivoting piece representing a leg, on which a slitted piece supporting the body of the dinosaur rests. A puzzle representing a dinosaur which can rock on its appendages or otherwise positioned is thereby created.

3 Claims, 3 Drawing Sheets

THREE DIMENSIONAL PUZZLE

CROSS-REFERENCE TO RELATED APPLICATION

This application is based on provisional patent application Ser. No. 60/004,629, filed Sep. 26, 1995.

BACKGROUND OF THE INVENTION

1. Field of the Invention

The present invention relates to a three-dimensional, representational puzzle having frictionally mating pieces with selected pivoting pieces which allow motion of the puzzle when assembled. The exemplary puzzle is representative of a dinosaur, wherein a V-shaped cut-out is provided a pivoting piece forming a leg on which a slitted piece supporting the body of the dinosaur rests, whereby a puzzle representing a dinosaur which rocks on its appendages is created.

2. Description of Prior Art

The prior art is replete puzzles and toys having interlocking and movable parts. However, each teaches different structures having different purposes which are inappropriate to the present invention. For example and most notably, U.S. Pat. No. 4,118,887, issued on Oct. 10, 1978, to Appleman describes a take-apart figure toy having manually movable planar appendages attached to a planar body. The body is provided with a pair of elongated grooves positioned on each planar surface of the body. The appendages have a slit defining a pair of arms each terminating in a lug which engages the body in one of the pair of grooves such that the plane of the appendage is perpendicular to that of the body. The appendages are thereby capable of angularly pivoting on the lugs, as there is no corresponding slit in the body to lock the appendage to the body. Moreover, the direction of the angular motion allowed by the pivoting lugs is in the plane of the body, unlike the present invention which allows angular motion directed in the plane of the appendage. The angular motion as allowed by the Appleman toy is particularly disadvantageous as it relates to the present invention because it would promote the toppling of the present invention, as will become obvious later. Furthermore, the appendages of the Appleman toy are not freely engaged with the body, and rely upon the lugs to prevent slippage of the appendage from the grooves, unlike the present invention.

In U.S. Pat. No. 4,192,509, issued on Mar. 11, 1980, to Singh, a three dimensional puzzle which has moving parts is described. Parts are movably pinned by means of rods inserted in boreholes in the parts. This construction format requires an additional individual part to enable an appendage to pivot and lacks simplicity.

Other three-dimensional, sectional toys having non-pivoting parts are of course also known. U.S. Pat. No. 3,407,530, issued on Oct. 29, 1968, to Grant et al describes toy which when correctly sectionally formed identifies the name of the figure it represents. Using single letter indicia on each the sections, the toy is assembled in the manner of an anagram to properly form the word and uses magnets to join the different sections. Another constructional toy having slitted interfitting parts and a plurality of parts which can be arbitrarily assembled into non-representational structures is shown in U.S. Pat. No. 3,560,169 issued Mar. 16, 1971 to Jacob.

U.S. Pat. No. Des. 257,373 issued on Oct. 14, 1980, to Kodaka is notable for showing an ornamental design for a dinosaur figure having interlocking pieces. Other dinosaur figures of lesser resemblance to the present invention are shown in U.S. Design Pat. Nos. 257,369, 257,370, 257,371, and 257,372, and U.S. Des. Pat. No. 257,514 issued to Kodaka. However, no part of any of the figures can be reasonably understood to pivot.

SUMMARY OF THE INVENTION

The present invention relates to a three-dimensional, representational puzzle having frictionally mating pieces with selected pivoting pieces which allow motion of the puzzle when assembled. The exemplary puzzle is representative of a dinosaur, wherein a V-shaped cut-out is provided a pivoting piece forming a leg on which a slitted piece supporting the body of the dinosaur rests, whereby a puzzle representing a dinosaur which rocks on its appendages is created.

Notably, to allow the dinosaur to rock or its legs to be variably positioned, a pair of mating pieces allow angular motion to occur in the longitudinal axis of the figure represented as the dinosaur. The angle of the V-shaped cut-out limits the forward and rearward rocking motion of the puzzle toy in the longitudinal axis, by defining a forward and rearward point of abutment between the edges of the V-shaped cut-out and the planar surface of the corresponding mating piece. A corresponding mating slitted piece defines a slit having parallel edges which limit lateral motion of the toy, thereby preventing it from toppling sideways. The preferred embodiment of the present invention provides the V-shaped cut-out in the appendages of the figure only, such as the legs, wherein the weight to the remaining body of the dinosaur puzzle is freely supported by the appendages and without frictionally interlocking.

Accordingly, it is a principal object of the invention to provide a three dimensional puzzle including a mating piece having a slit and a piece having a V-shaped cut-out which allow correspondingly mated pieces to pivot.

It is another object of the invention to provide a three dimensional puzzle which allows the puzzle to rock when assembled.

It is a further object of the invention to provide a three dimensional puzzle wherein pivoting pieces prevent lateral motion of the assembled puzzle but allow limited longitudinal angular motion.

It is an additional object of the invention to provide a three dimensional puzzle which is representational of a figure.

Still another object of the invention is to provide improved elements and arrangements thereof in a method and apparatus providing pivoting interlocking pieces for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENT

The present invention relates to a three-dimensional, representational puzzle having frictionally mating pieces with selected pivoting pieces which allow motion of the puzzle when assembled. The exemplary puzzle is representative of a dinosaur, wherein a V-shaped cut-out is provided a pivoting piece representing a leg, on which a slitted piece supporting the body of the dinosaur rests. A puzzle representing a dinosaur which rocks on its appendages can thereby be created.

Figure 1:
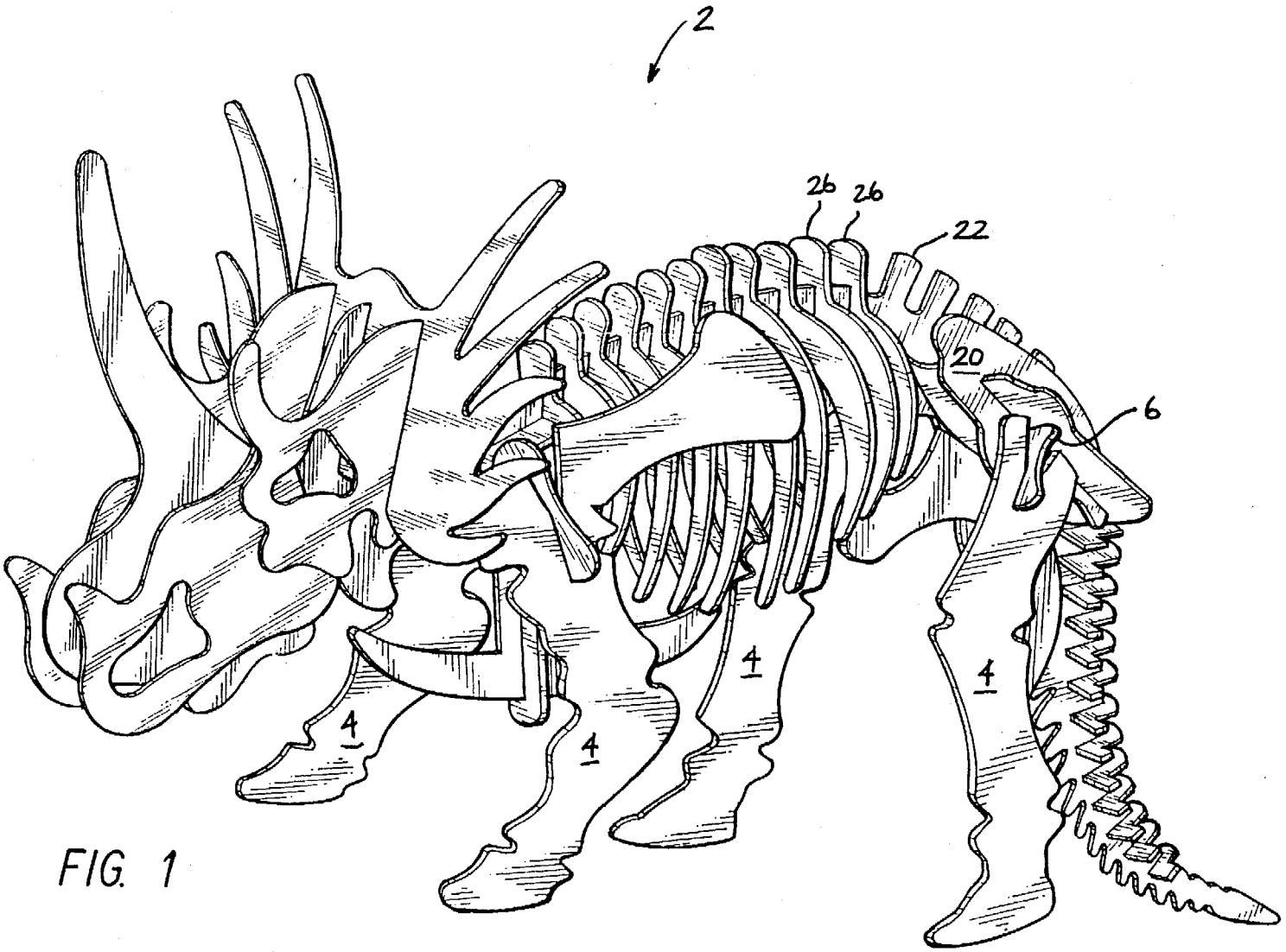
FIG. 1 is a perspective view of the assembled puzzle.

FIG. 1 shows the preferred embodiment of the assembled puzzle 2 of the invention. The assembled puzzle 2 represents a dinosaur figure. Although such embodiment and figure is used to illustrate the invention, it shall be appreciated that the invention is equally applicable to other forms of puzzles such as, for example, other types of dinosaurs, geometric shapes, or simulated humans, animals or any other form which might be desired, wherein the puzzle provides pivoting pieces as constructed in accordance with the specification provided herein.

The assembled puzzle 2 comprises a plurality of interlocking and removable pieces. Each of the pieces defining the body of the dinosaur are slitted such that one piece frictionally depends from another and forms a substantially rigid assembly. The assembly comprising the head, torso and tail of the dinosaur can be understood to define an imaginary longitudinal axis passing from head to tail, and an imaginary lateral axis passing from leg to leg of each of the shoulder and hip girdles.

A pivoting piece 4 is provided for each one of the back legs of the dinosaur figure; a mating slitted piece 6 is a cross member removably attached to both the pivoting piece 4 and a hip piece 20 along the lateral axis. Behind the hip piece 20, a spine piece 22 longitudinally supports a series of rib pieces 26. Additional unnumbered pieces further comprise the puzzle as needed to complete the representation of the dinosaur. Each of the pieces (6,20,22,26 and unnumbered) thus define a head, torso and tail of the dinosaur (herein "body of the dinosaur"), excepting the pivoting pieces 4 which define its legs.

Figure 2:
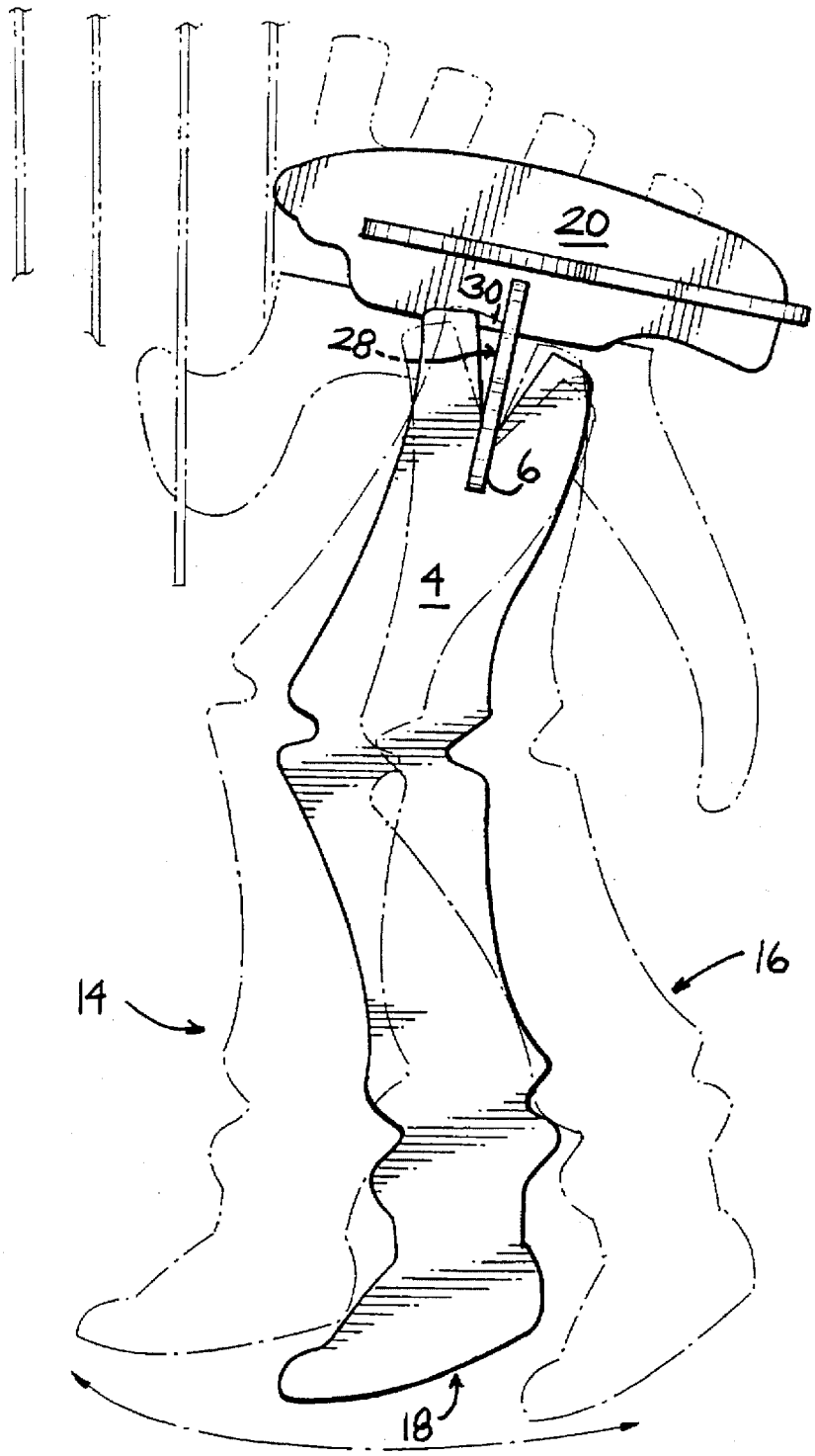
FIG. 2 is a side elevational view of the pivoting piece and its mating slitted piece as an assembly, the phantom lines representing the range of motion through which the pivoting piece may pivot, and drawn to an enlarged scale.
Figure 3:
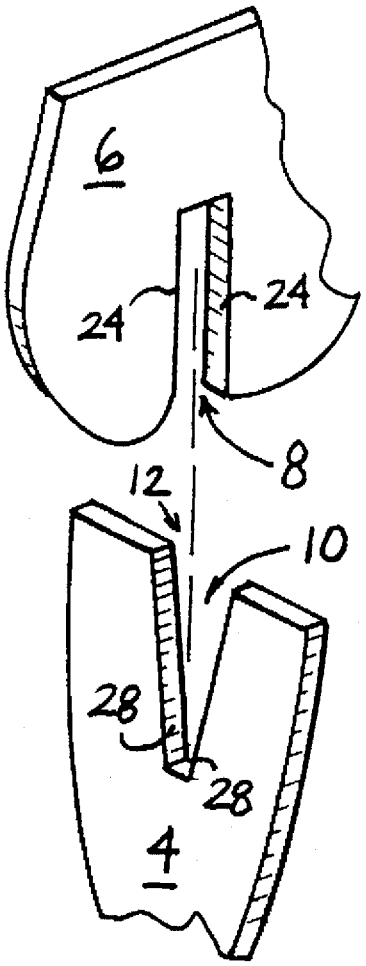
FIG. 3 is a fragmentary, exploded perspective view showing the pivoting piece and mating slitted piece of the assembly as shown in FIG. 2.

As can be more readily appreciated from both FIG. 2 and FIG. 3, the inventive features of the assembled puzzle 2 reside in the relationship and functional design of the pivoting piece 4 and corresponding mating slitted piece 6. The mating slitted piece 6 is set at substantially a right angle to both the pivoting piece 4 and the hip piece 20 to provide an axle along the lateral axis of the dinosaur on which the body of the dinosaur rides. When the body of the dinosaur is placed upon each of the four legs (pivoting pieces 4) as a complete assembly, the figure is capable of a rocking motion as represented in FIG. 2.

In FIG. 3, the mating slitted piece 6 is provided with a first slit 8 and a second slit (not shown). The first slit 8 is defined by parallel edges 24,24 which are spaced apart to closely match the thickness of the pivoting piece 4 thereby allowing close passage of the pivoting piece 4 within the slit. The second slit (not shown) is slitted with parallel edges which in mating piece 6 frictionally engages and rigidly interlocks with the body of the hip piece 20 thereby forming the axle as previously noted.

In comparison to the second slit, the edges 24,24 defining the first slit 8 may be spaced apart slightly more than the edges defining the second slit. Such spacing allows the first slit 8 to be assembled in combination with the pivoting piece 4, without frictionally interlocking, yet allowing a secured assembly for pivotally supporting the assembly of the head, torso and tail and prevent tipping of the figure laterally. The pivoting piece 4 defines a V-shaped cut-out 10 at the upper end of the leg (as can be appreciated from FIG. 2). The cut-out 10 defines two converging edges 28,28 having substantially equal lengths and includes a mouth 12 at the top of the leg which is wider than the apex where the edges 28,28 converge. In the lateral axis, the edges 24,24 of slit 8 prevent lateral motion (a sideways tipping over of the figure). When such lateral motion occurs, the edges 24,24 abut against the body of pivoting piece 4.

For example in FIG. 2, the edges 28,28 of the pivoting piece 4 are shown drawn relative to a forward position 14, a rearward position 16 and a centered position 18, which represent the longitudinal or rocking motion of the leg. It can be appreciated that, in the centered position 18, the pivoting piece 4 supports the weight of the body of the dinosaur, wherein the cut-out 10 is generally centered on the mating slitted piece 6, thereby bisecting the cut-out 10. As contrasted to the forward position 14, the phantom line at 30 suggests that the edge 28 of the cut-out 10 limits any further forward motion by abutting with the mating slitted piece 6. It should be understood that a rearward limit of motion is likewise established by the opposing edge 28.

Clearly the angle defined by the cut-out can be altered to define a suitable limit of range of motion depending upon the center of gravity and other characteristics of the figure which would affect the enjoyment of use of the puzzle when assembled. For example, the cut-out allows various still positions to be assembled in which one rear leg may be forward and the other rearward to effect a stride-like appearance of the figure. Also, although the preferred embodiment of the present invention provides the V-shaped cut-out in the legs of the figure only (so that the weight to the body of the dinosaur puzzle is freely supported by the legs without frictionally interlocking), it should also be obvious that other pieces of the figure may be adapted by such pivoting means to allow motion in other parts of the puzzle, particularly the tail appendage which is allowed contact with a support surface thereby enabling the simple motion described above. Finally, to assist the assembler of the puzzle, each piece may include visual indicia, such as corresponding or matching numbers or letters, by each slit or cut-out to allow the assembler to match corresponding pieces to properly assemble the puzzle figure.

It is to be understood that the present invention is not limited to the sole embodiment described above, but encompasses any and all embodiments within the scope of the following claims.

I claim:

1. A three-dimensional representational puzzle comprising:

a plurality of puzzle pieces which when assembled represent a figure, each of the plurality of puzzle pieces having a predetermined shape and being constructed of a rigid sheet material having surfaces being substantially parallel and planar and a substantially uniform thickness, the plurality of puzzle pieces including a selected number of puzzle pieces further having frictional engaging means for frictionally interlocking one puzzle piece with at least one other puzzle piece at right angles to each other, at least one slitted piece having at least two parallel edges defining a generally U-shaped slit, the slit being dimensioned to allow close passage of the thickness of a puzzle piece, and, at least one pivoting leg piece including a lower end for resting on a supporting surface and an upper end having two converging edges defining a generally V-shaped cut-out, said two converging edges being substantially equal in length, said slitted piece assembled at right angles to said pivoting leg piece, the converging edges of the cut-out defining a maximum range of angular motion of said pivoting leg piece in a plane parallel to the surfaces of said pivoting leg piece and the at least two parallel edges of the slit preventing angular motion of said pivoting leg piece lateral to the surfaces of said pivoting leg piece.

2. The three-dimensional representational puzzle according to claim 1, wherein the frictional engaging means includes at least one slit defined by the puzzle piece having at least two parallel edges forming a generally U-shaped slit to allow close passage of the thickness of a puzzle piece such that the puzzle pieces are frictionally interlocked.

3. The three-dimensional representational puzzle according to claim 1, wherein the figure represents a dinosaur.

* * * * *